United States Patent [19]

Tsuji et al.

[11] Patent Number: 4,899,092

[45] Date of Patent: Feb. 6, 1990

[54] JUXTAPOSED DISCHARGE TUBES WITH OPPOSED TRIGGER ELECTRODES

[75] Inventors: Kenji Tsuji; Tsutomu Ichikawa, both of Kashiwara, Japan

[73] Assignee: Minolta Camera Kabushiki Kaisha, Osaka, Japan

[21] Appl. No.: 361,829

[22] Filed: Jun. 2, 1989

Related U.S. Application Data

[63] Continuation of Ser. No. 101,814, Sep. 28, 1987, abandoned.

[30] Foreign Application Priority Data

Sep. 29, 1986 [JP] Japan ..... 61-230778

[51] Int. Cl.[4] ..... H01J 61/54

[52] U.S. Cl. ..... 313/594; 313/601; 313/607; 315/241 P; 362/225

[58] Field of Search ..... 313/234, 594, 596, 601, 313/602, 607, 622; 315/241 P, 241 S; 362/223, 225

[56] References Cited

U.S. PATENT DOCUMENTS

| | | | |
|---|---|---|---|
| 1,990,170 | 2/1935 | Dellian | 313/596 |
| 3,682,056 | 8/1972 | Tokutomi | 315/241 P |
| 3,821,750 | 6/1974 | Murakami et al. | 354/419 |
| 3,940,659 | 2/1976 | Kojima et al. | 315/241 P |
| 3,953,763 | 4/1976 | Herrick | 315/262 |
| 3,978,370 | 8/1976 | Stieringer | 315/151 |
| 4,143,955 | 3/1979 | Matsumoto | 354/413 |
| 4,228,381 | 10/1986 | Hasegawa | 315/151 |
| 4,246,514 | 1/1981 | Metzger | 315/241 P |
| 4,344,020 | 8/1982 | Horinishi | 315/241 P |
| 4,393,335 | 7/1983 | Hirata et al. | 315/241 P |

FOREIGN PATENT DOCUMENTS

| | | | |
|---|---|---|---|
| 2385978 | 3/1977 | France | 362/225 |
| 56-16115 | 2/1981 | Japan . | |

*Primary Examiner*—Robert L. Griffin
*Assistant Examiner*—T. Salindong
*Attorney, Agent, or Firm*—Price, Gess & Ubell

[57] ABSTRACT

A light emitting device wherein one of a plurality of juxtaposed discharge tubes which is to remain not emitting light is prevented from being caused to emit light by induction by an adjacent one of the discharge tubes which is to emit light, thereby enabling fully independent control of light emission by the discharge tubes. In the light emitting device, trigger electrodes of each adjacent ones of a plurality of juxtaposed discharge tubes are located at opposite positions to each other with respect to the adjacent discharge tubes.

4 Claims, 1 Drawing Sheet

JUXTAPOSED DISCHARGE TUBES WITH OPPOSED TRIGGER ELECTRODES

This is a continuation of application Ser. No. 101,814, filed Sept. 28, 1987, now abandoned.

BACKGROUND OF THE INVENTION

1. Field of the Invention

This invention relates to a synchronized light emitting device which is used, for example, for photographing.

2. Description of the Prior Art

Among various light emitting devices wherein energy for emission of light is accumulated in a main capacitor and then the accumulated charge is discharged through a discharge tube in order to cause the discharge tube to emit light, there is a type of light emitting device which includes a plurality of juxtaposed discharge tubes and allows such a selective operation that one of the discharge tubes is selectively caused to emit light or some or all of the discharge tubes are caused to emit light at a same time.

Now, construction in principle of a light emitting device of the type mentioned will be described with reference, for convenience of description, to a circuit diagram of FIG. 2 which shows a preferred embodiment of the present invention The circuit shown includes a main capacitor Co for accumulating energy for emission of light therein. The main capacitor Co is charged up to a predetermined high voltage by a charging circuit not shown. The circuit further includes a pair of xenon lamps Xe1, Xe2 for emitting light therefrom, a pair of triggering capacitors C1, C2 connected to be charged up to the same voltage with the main capacitor Co, and a pair of triggering transformers T1, T2. Now, if it is intended to cause only the xenon lamp Xe1 to emit light, a signal of a high voltage level is applied to a terminal T of the circuit with the charging of the capacitor C2 stopped in advance. Consequently, a silicon controlled rectifier SCR1 is turned on to cause the capacitor C1 to discharge so that an impulse of a high voltage is produced on the secondary side of the transformer T1 and triggers the xenon lamp Xe1 to discharge. To the contrary, in case it is intended to cause both of the xenon lamps Xe1, Xe2 to emit light at a same time, a signal of a high voltage level is applied to the terminal T with the capacitors C1, C2 charged up to the predetermined voltage in advance. Consequently, the silicon controlled rectifier SCR1 is turned on so that the xenon lamps Xe1, Xe2 are both triggered.

However, in such a conventional light emitting device, trigger electrodes of a plurality of discharge tubes are provided at like locations of the individual discharge tubes. Accordingly, when it is intended to cause one of a pair of adjacent discharge tubes to emit light and cause the other to remain not emitting light, if a trigger signal is applied to the one discharge tube so as to cause the same to emit light, sometimes the other adjacent discharge tube to remain not emitting light may also be triggered by induction.

As described above, when a xenon tube in a light emitting device is to be caused to emit light, a high voltage impulse is applied to a trigger electrode located outside the xenon tube so as to cause discharging in the xenon tube, whereafter the gas discharging within the xenon tube, is continued with discharge current flow from a main capacitor. However, when it is intended to cause a selected one of a plurality of xenon tubes to emit light, there is a problem that, if a high voltage impulse is applied to the trigger electrode of the selected xenon tube, a strong electric field is produced also around a trigger electrode of an adjacent xenon tube by electrostatic induction or by electric breakdown of air and triggers the adjacent xenon tube to emit light. A trigger electrode in a light emitting device is located adjacent a wall of a discharge tube as shown in FIGS. 3*a* or 3*b*. In FIGS. 3*a* and 3*b* reference symbol Q denotes a discharge tube, and g a trigger electrode, and FIG. 3*a* shows discharge tubes which each has a conductor ring as a trigger electrode wound around a portion near an end thereof at which a negative electrode is located while FIG. 3*b* shows another discharge tubes which each has a trigger electrode located along a side thereof and extending along the length thereof. In the arrangement shown in FIG. 3*a*, if a high voltage is applied only to the trigger electrode g1 of a left-hand side discharge tube Q1 in order to cause the discharge tube Q1 to emit light, a strong electric field is formed between the trigger electrode g1 and the cathode K1 of the discharge tube Q1 and causes discharging between the cathode K1 and the trigger electrode g1, thereby triggering discharging of the entire discharge tube Q1. In this instance, electric fields are produced as indicated in broken lines in FIG. 3*a* by electrostatic induction, and one of the electric fields which is produced between the trigger electrode g2 and the cathode K2 of the adjacent discharge tube Q2 may sometimes cause triggering of the adjacent discharge tube Q2. This also applies to the arrangement of FIG. 3*b*.

SUMMARY OF THE INVENTION

It is an object of the invention to provide a light emitting device wherein one of a plurality of discharge tubes which is to remain not emitting light is prevented from being caused to emit light by induction by an adjacent one of the discharge tubes which is to emit light. In order to attain the object, according to the present invention, there is provided a light emitting device of the type which includes a plurality of discharge tubes arranged in a juxtaposed relationship and each having a trigger electrode and wherein the discharge tubes are selectively controlled such that one of the discharge tubes is selectively caused to emit light or some or all of the discharge tubes are caused to emit light at a same time, wherein the trigger electrodes of each adjacent ones of the discharge tubes are located at opposite positions to each other with respect to the adjacent discharge tubes.

With the light emitting device of the present invention, the trigger electrodes are located at opposite positions to each other with respect to the adjacent discharge tubes. Accordingly, even if a high voltage is applied to one of the trigger electrodes, an electric field produced around the trigger electrode of the adjacent discharge tube is spaced far away from the one trigger electrode so that it will not cause discharging of the adjacent discharge electrode. Accordingly, the light emitting device of the present invention eliminates a problem that a discharge tube which is to remain not emitting light therefrom may be caused to emit light by induction. Therefore, the light emitting device of the present invention enables fully independent control of light emission by a plurality of discharge tubes which are arranged in a juxtaposed relationship to each other.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1A:
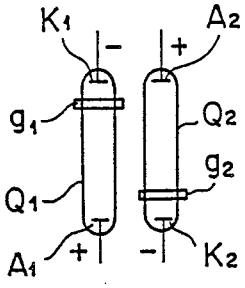
FIG. 1*a* is a schematic plan view showing the arrangement of trigger electrodes of a light emitting device according to a preferred embodiment of the present invention.
Figure 1B:
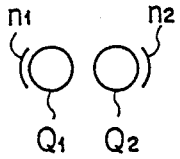
FIG. 1*b* is a schematic transverse sectional view showing another arrangement of trigger electrodes in a light emitting device according to another preferred embodiment of the present invention.
Figure 1C:
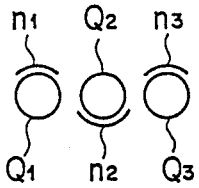
FIG. 1*c* is a schematic transverse sectional view showing another arrangement of trigger electrodes in a light emitting device according to a further preferred embodiment of the present invention.

Referring first to FIGS. 1*a*, 1*b* and 1*c*, there are shown different preferred embodiments of the present invention. These embodiments have a common feature that two xenon tubes Q1, Q2 arranged in a juxtaposed relationship are either caused to emit light at a same time or selectively operated so that only one Q1 or Q2 of the two is caused to emit light. In the arrangement shown in FIG. 1*a*, each of trigger electrodes g1, g2 is formed from a conductor ring, and the xenon tubes Q1, Q2 are connected such that the positive electrode A and the negative electrode K of one of them are located at opposite positions to those of the other xenon tube, or in other words, the positive electrode A and the negative electrode K of one of the xenon tubes Q1, Q2 are located adjacent the negative electrode K and the positive electrode A, respectively, of the other xenon tube Q2, Q1. The conductor rings g1, g2 are wound at portions near ends of the xenon tubes Q1, Q2, respectively, adjacent the negative electrodes k1, k2. Meanwhile, in the arrangement shown in FIG. 1*b*, NESA coatings n1, n2 are employed as trigger electrodes. Each of the NESA coated electrode n1, n2 is a net-like or transparent electrode located so as to extend over about 90 degrees in a circumferential direction around an outer periphery of an associated discharge tube and along the length of the discharge tube. The NESA coated electrodes n1, n2 are located at opposite positions relative to each other with respect to the tubes Q1 Q2. On the other hand, FIG. 1*c* illustrates an example of arrangement of NESA coated electrodes where three or more discharge tubes Q1, Q2, Q3, . . . are involved. In this instance, if such an arrangement as in FIG. 1*b* is employed for the light emitting device which includes three or more discharge tubes, the NESA coated electrodes n2, n3 for the second and third discharge tubes Q2, Q3 will be located very near in back-to-back relationship to each other. In the arrangement of FIG. 1*c*, the NESA coated electrodes for each two adjacent discharge tubes are always located at opposite positions to each other with respect to a plane in which the discharge tubes are arranged so that they are spaced away from each other by a greater distance than that in the arrangement of FIG. 1*b*. Thus, when a trigger voltage is applied to one of the NESA coated electrodes an electric field produced around the NESA coated electrode of an adjacent discharge tube by electrostatic induction is sufficiently small so that it will not induce discharging of the adjacent discharge tube.

It is to be noted that while in the embodiment described above the trigger electrodes are located at opposite positions to each other with respect to the associated discharge tubes, it is a matter of course that the trigger electrodes may otherwise be located in a spaced relationship from each other by a distance sufficient to cause no insulation breakdown nor electrostatic induction. Generally, since insulation breakdown of air occurs if a voltage higher than 1 KV is applied for a distance of 1 mm, the minimum distance which does not cause insulation breakdown is determined decisively from the relationship described above and a trigger voltage to be applied.

Figure 2:
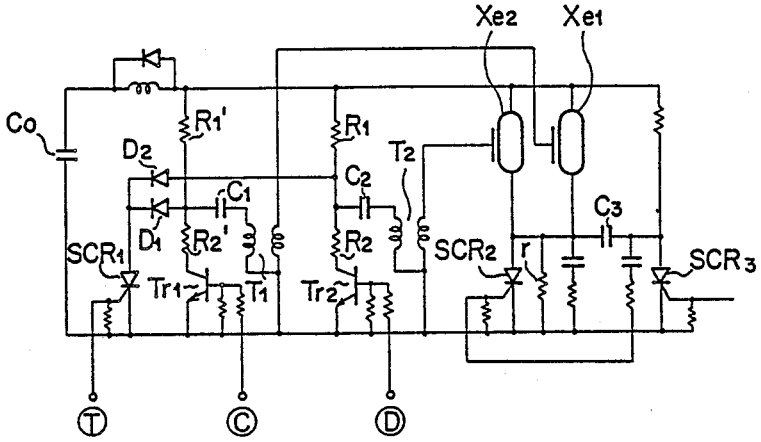
FIG. 2 a circuit diagram of an exemplary electric circuit for a light emitting device of the present invention.
Figure 3A:
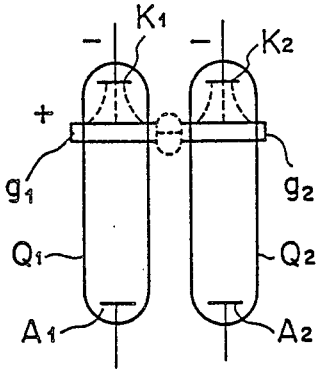
FIG. 3a PRIOR ART
FIGS. 3*a* and 3*b* are schematic plan views showing exemplary arrangements of trigger electrodes of discharge tubes of conventional light emitting devices.
Figure 3B:
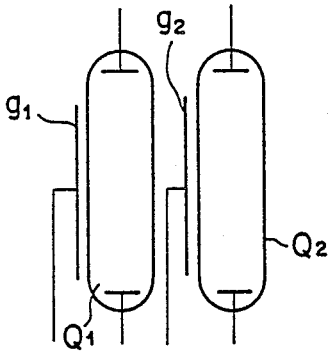
FIG. 3b PRIOR ART

FIG. 2 shows an exemplary circuit for a light emitting device of the present invention. The circuit shown includes a pair of xenon lamps Xe1, Xe2 for emitting light therefrom, and a main capacitor Co for accumulating energy for emission of light therein. The main capacitor Co is charged up to a predetermined voltage by a charging circuit not shown. The circuit further includes a pair of trigger capacitors C1, C2 each having one electrode thereof connected to the primary winding of a corresponding one of a pair of triggering transformers T1, T2, respectively, while the other electrodes of the trigger capacitors C1, C2 are connected to a common discharging circuit via a pair of diodes D1, D2, respectively. The discharging circuit includes a single silicon controlled rectifier SCR1 interposed therein. Poles of the triggering capacitors C1, C2 at which the discharging circuit is connected are connected respectively to junctions between voltage dividing resistors R1, R2 and R1′, R2′ for dividing a charged voltage of the main capacitor Co. A pair of transistors Tr1, Tr2 serving as switching means are connected in series to the voltage dividing resistors R1, R2 and R1′, R2′, respectively. The bases of the transistors Tr1, Tr2 are connected so as to receive different signals thereat. Now, if it is intended to maintain the xenon lamp Xe2 not emitting light therefrom, a signal of a high voltage level is applied to a terminal D of the circuit while another terminal C is maintained at a low voltage level. Consequently, the transistor Tr1 is conducting while the transistor Tr2 is held at cutoff. Accordingly, the triggering capacitor C1 is charged to a substantially same voltage with the main capacitor Co while the other triggering capacitor C2 is charged only to a voltage of the charged voltage of the main capacitor Co divided by the voltage dividing resistors R1, R2. Therefore, the voltage which appears at the secondary side of the transformer T2 when the triggering capacitor C2 is caused to discharge does not reach a level by which the xenon lamp Xe2 is triggered, and consequently the xenon lamp Xe2 is not caused to emit light.

To the contrary, when it is intended to cause both of the xenon lamps Xe1, Xe2 to emit light at a same time, the terminals C, D of the circuit are both held at the low voltage level so that the triggering capacitors C1, C2 are charged up to the same voltage with the main capacitor Co. In this condition if a signal of a high voltage level is applied to the terminal T of the circuit the silicon controlled rectifier SCR1 is rendered conducting so that the capacitors C1, C2 will discharge in a same phase. Consequently, high voltage impulses of the same phase appear at the secondary sides of the transformers T1, T2 so that the xenon lamps Xe1, Xe2 are caused to emit light, respectively.

Now, a circuit for the xenon lamps Xe1, Xe2 are described briefly. Initially, a capacitor C3 is charged at a right-hand side terminal thereof to the same positive voltage with the main capacitor Co. As at least one of the xenon lamps Xe1, Xe2 is triggered, the voltage at an upper terminal in FIG. 2 of a resistor r rises, and such voltage rise is transmitted to the gate of another silicon controlled rectifier SCR2 via the capacitor C3 so that the silicon controlled rectifier SCR2 is turned on, thereby continuing discharging of the xenon lamp. Then, if a light emission stopping signal is applied to the gate of a further silicon controlled rectifier SCR3, the right-hand side terminal of the capacitor C3 is dropped to the low level. Consequently, the left-hand side terminal of the capacitor C3 is dropped to a negative level so that the silicon controlled rectifier SCR2 is turned off, thereby stopping discharging of the xenon lamp.

As described hereinabove, when it is intended to cause only one of the xenon lamps, for example, only the xenon lamp Xe1, to emit light, the terminal C is set to the low level while the terminal D is set to the high level so as to keep the charged voltage of the capacitor C2 to a level sufficiently lower than the charged voltage of the main capacitor Co. In this condition, if the silicon controlled rectifier SCR1 is rendered conducting to cause discharging of the capacitor C2, a sufficiently high voltage to trigger a xenon lamp will not appear at the secondary side of the transformer T2, and accordingly, the xenon lamp Xe2 does not emit light. In such a case as described above, the diodes D1, D2 prevent the charged voltage of the capacitor C1 during charging of the capacitors C1, C2 from being transmitted to the capacitor C2 to cause the capacitors C1, C2 to be charged to a same voltage. In other words, the diodes D1, D2 are provided for allowing the capacitors C1, C2 to be charged independently of each other.

Having now fully described the invention, it will be apparent to one of ordinary skill in the art that many changes and modifications can be made thereto without departing from the spirit and scope of the invention as set forth herein.

What is claimed is:

1. In a light emitting device which includes a plurality of discharge tubes arranged in a juxtaposed relationship and each having first and second electrodes to which energy for emitting light is applied and a trigger electrode to which a predetermined voltage to trigger energization of the corresponding discharge tube is applied, and wherein said discharge tubes are selectively controlled such that one of said discharge tubes is selectively caused to emit light or some or all of said discharge tubes are caused to emit light at the same time, the improvement wherein the trigger electrodes of each adjacent ones of said discharge tubes are located at opposite positions to each other with respect to the adjacent discharge tubes, wherein the trigger electrodes of each adjacent ones of said discharge tubes are located in a spaced relationship in a direction of the length of the discharge tubes by a distance insufficient to induce discharging of one of the adjacent discharge tubes when a predetermined voltage is applied to a trigger electrode of a different adjacent discharge tube to cause discharging of the latter.

2. A light emitting device as claimed in claim 1, wherein the trigger electrodes of each adjacent ones of said discharge tubes are located at opposite positions to each other with respect to a plane in which said discharge tubes are arranged.

3. A light emitting device as claimed in claim 1, wherein the quantity of said discharge tubes is two, and the trigger electrodes of the two discharge tubes are located at opposite positions to each other in a direction of the length of the discharge tubes.

4. A light emitting device as claimed in claim 1, wherein the quantity of said discharge tubes is two, and the trigger electrodes of the two discharge tubes are located at opposite positions to each other with respect to the two juxtaposed discharge tubes.

* * * * *